United States Patent [19]

Teltscher

[11] Patent Number: 4,787,415

[45] Date of Patent: Nov. 29, 1988

[54] VALVE

[75] Inventor: Rainer Teltscher, Waagkirchen, Fed. Rep. of Germany

[73] Assignee: Concordia Fluidtechnik GmbH, Stuttgart, Fed. Rep. of Germany

[21] Appl. No.: 100,027

[22] Filed: Sep. 23, 1987

[51] Int. Cl.[4] ..... F15B 13/043

[52] U.S. Cl. ..... 137/596.15; 137/596.16; 251/29

[58] Field of Search ..... 137/596.15, 596.16; 251/29

[56] References Cited

U.S. PATENT DOCUMENTS

| | | | |
|---|---|---|---|
| Re. 29,481 | 11/1977 | Larner | 137/596.15 |
| 2,911,005 | 11/1959 | Adelson | 137/596.15 |
| 4,516,604 | 5/1985 | Taplin | 137/596.15 |
| 4,540,020 | 9/1985 | Taplin | 137/596.15 |

FOREIGN PATENT DOCUMENTS 3313791 10/1984 Fed. Rep. of Germany .

*Primary Examiner*—Gerald A. Michalsky

*Attorney, Agent, or Firm*—Learman & McCulloch

[57] ABSTRACT

The invention relates to a valve with at least one diaphragm valve element, two servo valve elements and an inverter valve element. The valve according to the invention is distinguished by impulse actuation.

6 Claims, 4 Drawing Sheets

VALVE

This invention relates to an impulse actuated valve.

BACKGROUND OF THE INVENTION

A valve of the type to which this invention pertains is the subject matter of German Patent Specification No. A-35 09 032.4. It is actuated by means of a servo valve element using an actuating signal which is maintained as long as the valve is to stay in the switch position determined by this actuating signal.

There are numerous applications in which impulse actuation of such a valve is desirable, that is to say, actuation of the valve by means of a control impulse which is supplied for only a short time, with the valve then remaining in the switch position defined by this control impulse even in the absence of the control impulse.

SUMMARY OF THE INVENTION

The object of the invention is to construct a valve of this type in such a way that reliable impulse actuation is made possible by using simple means while retaining all the other advantages of this basic valve.

THE DRAWINGS

FIG. 1 shows a schematic longitudinal section through a first embodiment of a valve according to this invention, and FIGS. 2, 3 and 4 are schematic sections through three further embodiments of the invention.

DETAILED DESCRIPTION

Figure 1:
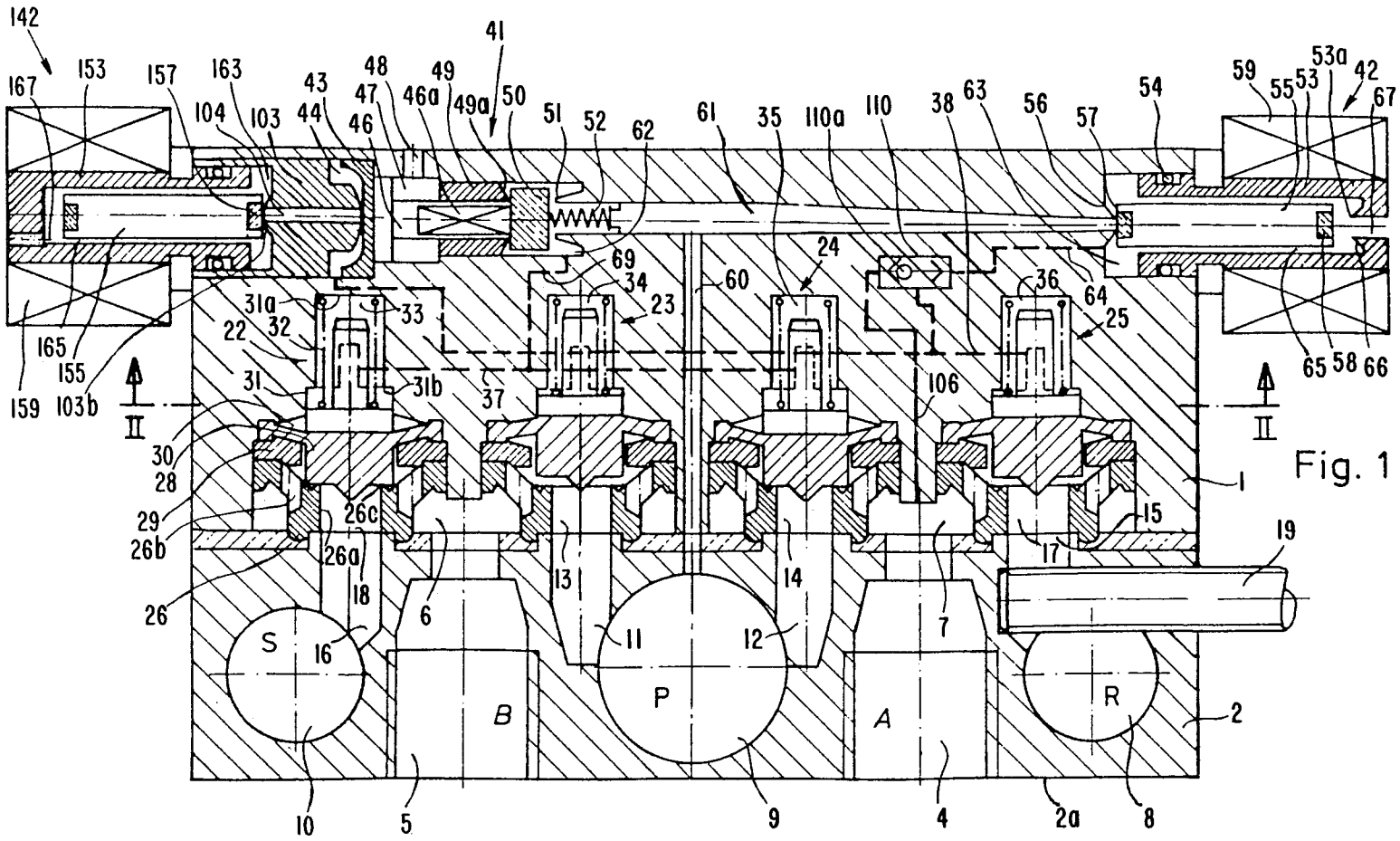

FIG. 1 shows the application of the invention to a so-called 5/2-way valve, that is to say, a multi-way valve with 5 connections and 2 switch positions.

For the following description the valve is assumed to be a pneumatic valve in which the pressure medium consists of compressed air. However, the invention is also applicable to hydraulic valves.

The housing of the valve shown in FIG. 1 consists of a housing body 1 and a base plate 2 which are connected to one another by screws (not shown).

The base plate 2 contains on its underside 2*a* a connection A for the supply of pressure medium to a first consuming device and a connection B for the supply of pressure medium to a second consuming device. From these connections A and B channels 4, 5 lead to connecting chambers 6, 7 in the housing body 1.

Three channels 8, 9 and 10 are also provided in the base plate 2 and run in a horizontal direction (i.e. perpendicular to the channels 4 and 5) from one broad side of the housing to the other. Of these the channel 9 is provided for the connection P for supply of pressure medium, whilst the channel 8 is intended for the connection R for removal of pressure medium from the first consuming device and the channel 10 is intended for the connection S for removal of the pressure medium from the second consuming device. Two channels 11 and 12 lead from the channel 9 to the connecting chambers 13, 14 in the housing body 1. Channels 15, 16 lead from the channels 8 and 10 to connecting chambers 17, 18 in the housing body 1.

A throttle element 19 which is adjustable at right angles to the channel axis engages in the channel 15 and can be used to throttle the pressure medium as it flows away. A corresponding throttle element (not shown) can also be provided in the channel 16.

Four valve elements 22, 23, 24 and 25 of similar construction are provided in the housing body 1, and of these the valve element 22 will be described in greater detail below.

It contains a cage 26 surrounding the connecting chamber 18 with a central bore 26*a* and a plurality of external bores 26*b* which open into the connecting chamber 6.

On the upper edge of the central bore 26*a* the cage 26 forms a valve seat 26*c* on which diaphragm 28 forming the movable valve body of the valve element 22 rests. A support ring 29 is provided between the outer edge of the diaphragm 28 and the outer edge of the cage 26.

A piston 30 which is slidably movable in a bore 31 on the housing body 1 rests on the upper surface of the diaphragm 28, illustrated in section. A compression spring 32 which is supported on the base 31*a* of the bore 31 acts on the piston 30.

The interior of the bore 31 forms a pressure chamber 33. The corresponding pressure chambers of the valve elements 23, 24 and 25 are designated by the reference numerals 34, 35 and 36 respectively.

The bore 31 is provided with a step 31*b* on which the piston 30 comes to a stop during its upward movement when the diaphragm 28 is lifted from the valve seat 26*c*.

The pressure chambers 33 and 35 of the valve elements 22, 24 are connected to one another by a connecting channel 37 which is only indicated schematically (broken lines) in the drawings. In a corresponding manner the pressure chambers 34 and 36 of the valve elements 23, 25 are connected to one another by a connecting channel 38.

The connecting channels 37 and 38 are advantageously arranged on different sides of the longitudinal central plane 20 of the valve. The channel 37 passes close by the pressure chamber 34 (without touching it), whilst the channel 38 passes close by the pressure chamber 35.

An inverter valve element 41 which is actuated via a first servo valve element 42 or a second servo valve element 142 is located in the upper part of the housing body 1.

The inverter valve element 41 contains a cup sleeve 43 which is located in a pressure chamber 44 which is closed towards the left by a nozzle element 103.

The cup sleeve 43 rests on a piston rod 46 passing through a chamber 47 from which air is extracted via a bore 48. The piston rod 46 also passes through a nozzle 49 which is pushed into the housing body 1. Between the piston rod 46 and the bore of the nozzle 49 there is a gap which is formed by a chamfered surface 46*a* of the piston rod 46.

The piston rod 46 is in contact on its right-hand end with a seal 50 which is movable between a left-hand valve seat 49*a* formed by the nozzle 49 and a right-hand valve seat 51 formed by the housing 1. A compression spring 52 seeks to press the seal 50 onto the left-hand valve seat 49*a*.

The servo valve element 42 contains a guide tube 53 which is inserted into the housing 1 with a seal 54 interposed. In the guide tube 53 a plunger 55 is movable between a nozzle 56 formed by the housing body 1 and a nozzle 53*a* formed by the guide tube 53. Sealing elements 57, 59 which co-operate with the nozzles 56 and 53*a* respectively are provided at both ends of the plunger. A coil 59 fixed on the housing 1 and placed on the guide tube 53 serves for actuation of the plunger 55.

A connecting channel 60 leads upwards from the channel 9 through the housing body 1 and opens into a connecting channel 61 which runs at right angles. At the left-hand end in the region of the valve set 51 this channel 61 opens into a pressure chamber 62 and at the right-hand end in the region of the nozzle 56 it opens into a pressure chamber 63. This pressure chamber 63 is connected via a connecting channel 64, an OR valve element 110 and the connecting channel 38 to the pressure chamber 44. Furthermore, the pressure chamber 63 is connected via a gap 65 on the periphery of the plunger 55 to a chamber 66 which communicates with the atmosphere via the bore 67 of the nozzle 53*a*.

The pressure chamber 62 of the inverter valve element 41 is connected via a channel 69 to the connecting channel 37 which has already been mentioned.

The nozzle element 103 of the second servo valve element 142 is provided with a bore 104 which opens into a nozzle 103*b*. The servo valve element 142 also contains a guide tube 153, a plunger 155 with sealing element 157 and a coil 159. Between the guide tube 153 and the plunger 155 there is a gap 165 by means of which the chamber 163 is connected to an air removal bore 167.

The two inputs of the OR valve element 110 already mentioned are connected to the connecting channels 64 and 106. The output of the OR valve element 110 is connected to the connecting channel 38. The movable valve body of the OR valve element 110 is designated by 110*a*.

The valve according to FIG. 1 functions as follows:

In the first switch position illustrated in FIG. 1 the inverter valve element 41 is located in the left-hand position in which the seal 50 is lifted from the valve seat 51. Consequently the pressure medium passes from the connection P via the channel 60, the pressure chamber 62 and the channels 69, 37 into the pressure chambers 33, 35 of the valve elements 22, 24. Consequently the diaphragms 28 of these valve elements 22, 24 rest on the appertaining valve seat 26*c*. Consequently also the passage of pressure medium between the connections B and S and between P and A are shut off.

At the same time, in this first switch position shown in FIG. 1, air is removed from the pressure chambers 34 and 36 of the valve elements 23, 25 via the OR valve element 110, the pressure chamber 63 and the bore 67. Consequently the diaphragms 28 of the valve elements 23, 25 are raised so that communication exists between the connections P and B and between A and R. Thus in this first switch position the consuming device connected to the connection B is supplied with compressed air, whilst air is removed form the consuming device connected to the connection A.

If the valve is now to be switched over from the first switch position to the second switch position by an impulse, the impulse signal is supplied to the servo valve element 42. Consequently the plunger 55 moves into its right-hand end position in which the nozzle 56 is exposed and the nozzle 53*a* is closed. Now the pressure medium passes from the connection P via the connecting channels 60, 61, the pressure chamber 63, the channel 64, and OR valve element 110 and the channel 38 into the pressure chamber 44. This moves the piston rod 46 towards the right so that the seal 50 rests on the valve seat 51. As a result the connection between the channel 61 and the pressure chambers 33, 35 of the valve elements 22, 24 is broken. At the same time air is removed from the pressure chambers 33, 35 via the channels 37, 69, the chamber 47 and the bore 48. At the same time the pressure chambers 34, 36 of the valve elements 23, 25 are supplied with pressure medium via the channel 64, the OR valve element 110 and the channel 38, so that the diaphragms 28 of the valve elements 23, 25 are pushed onto their valve seat.

Thus a connection is produced between the connections P and A and between the connections B and S, whilst the connection between the connections P and B and between the connections A and R is shut off.

In order for this second switch position to be maintained even in the absence of the actuating impulse supplied to the servo valve element 42, the pressure medium supplied to the connection A after the valve has been switched over as described above passes from the connecting chamber 7 via the connecting channel 106, the OR valve element 110 and the channel 38 into the pressure chamber 44. As a result the piston rod 46 still pushes the seal 50 onto the valve seat 51 (even when in the absence of the actuating impulse supplied to the servo valve element 42 the plunger 55 goes back to its left-hand position and thus breaks the connection between the channels 61 and 64).

Since the pressure in the connecting channel 106 (and the absence of the pressure in the channel 64) causes the valve body 110*a* of the OR valve element to be located in its right-hand position, the connection between the channel 38 and the channel 64 is broken so that air cannot be removed from the pressure chambers 34, 36 of the valve elements 23, 25 via the bore 67 if the plunger goes into its left-hand position in the absence of the actuating impulse.

Thus the way in which the connecting channel 106 and the OR valve element 110 function as explained above ensures that the second switch position of the valve elements, which is brought about by the actuating impulse supplied to the servo valve element 42, continues to be maintained after the actuating impulse ceases.

In order to switch the valve over into the first switch position an actuating impulse is supplied to the servo valve element 142. Consequently the plunger 155 goes into its left-hand position in which air is removed from the pressure chamber 44 via the bore 104, the chamber 163, the gap 165 and the bore 167. The piston rod 46 can now move towards the left under the effect of the pressure in the channel 61 so that the seal 50 is lifted from the valve seat 51. Now the pressure medium passes from the connection P via the channels 60, 61, the pressure chamber 62 and the channels 69, 37 into the pressure chambers 33, 35 of the valve elements 22, 24. At the same time air is removed from the pressure chambers 34, 36 of the valve elements 23, 25 via the channel 38, the pressure chamber 44, the bore 104 and the bore 167.

If the actuating impulse supplied to the servo valve element 142 ceases, so that the plunger 155 goes back into the right-hand position shown in FIG. 1, the valve maintains the switch position which it has reached (in which there is a link between the connections P and B as well as A and R, whilst the links between P and A as well as B and S are shut off). The valve is then switched over again from the switch position shown in FIG. 1 by an actuating impulse supplied to the servo valve element 42.

As can be seen from the description above, in the embodiment according to FIG. 1 the servo valve element 42 is constructed as a $\frac{3}{3}$-way valve, that is to say as a valve with 2 positions and 3 connections, its three connections being connected to the connection P, to one input of the OR valve element 110 and to the atmosphere.

The servo valve element 142 is constructed as a 2/2-way valve in which the two connections are connected to the pressure chamber 44 of the inverter valve element 41 and to the atmosphere.

The valve shown in FIG. 1 is, as already mentioned, a 5/2-way valve.

Figure 2:
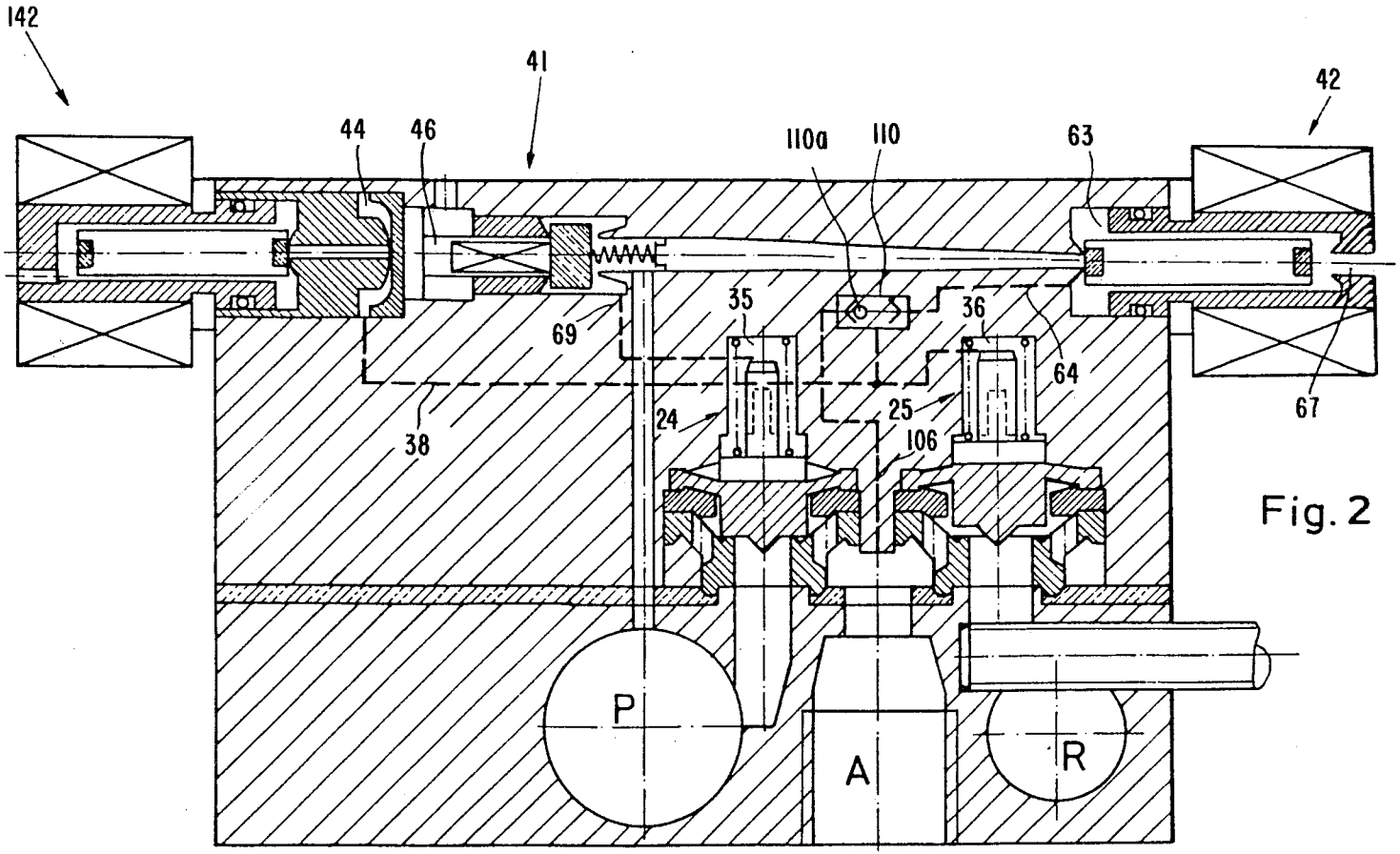

FIG. 2 shows in schematic form the application of the invention to a 3/2-way valve (i.e. in a valve with 3 connections and 2 switch positions). The same reference numerals as in FIG. 1 have been used for the same parts, so that in this respect a separate description is superfluous. It should, however, be emphasised that the representation in FIG. 2 has been kept quite schematic as regards the spatial arrangement of the valve elements. In a practical construction the housing of the valve can be kept substantially smaller by comparison with FIG. 1 because of the absence of two valve elements.

The valve shown in FIG. 2 contains a connection P for a pressure medium source, a connection A for the supply of pressure medium to a consuming device and a connection R for the removal of pressure medium from this consuming device.

Two valve elements 24, 25 are provided for the P/A and A/R functions (i.e. for connection of the connections P and A as well as the connections A and R). Their construction corresponds to that of the valve elements according to FIG. 1.

Furthermore the valve according to FIG. 2 is provided with two servo valve elements 42, 142 as well as an inverter valve element 41. Also the construction of these parts corresponds to the embodiment according to FIG. 1.

The way in which the valve according to FIG. 2 functions also corresponds to the principle of the variant according to FIG. 1.

In the illustrated switch position the valve element 24 is actuated so that the connection between the connections P and A is broken. Air is removed from the valve element 25 so that there is a connection between the connections A and R.

The valve is switched over by the supply of an actuating impulse to the servo valve element 42 so that the consuming device receives compressed air from the connection P via the connection A. When the actuating impulse ceases the pressure chamber 44 which is under pressure holds the piston rod 46 in the right-hand end position so that air is removed from the pressure chamber 35 of the valve element 24. At the same time the pressure in the channel 106 holds the valve body 110*a* of the OR valve element 110 in the right-hand end position so that the pressure chamber 36 of the valve element 25 is further acted upon by pressure medium from the channel 106 via the OR valve element 110 and a connection to the air removal bore 67 of the servo valve element 42 is broken.

If an actuating impulse is then supplied to the servo valve element 142 this results in air being removed from the pressure chamber 44, whereupon the valve elements 24, 25 are switched over in the manner already described.

Figure 3:
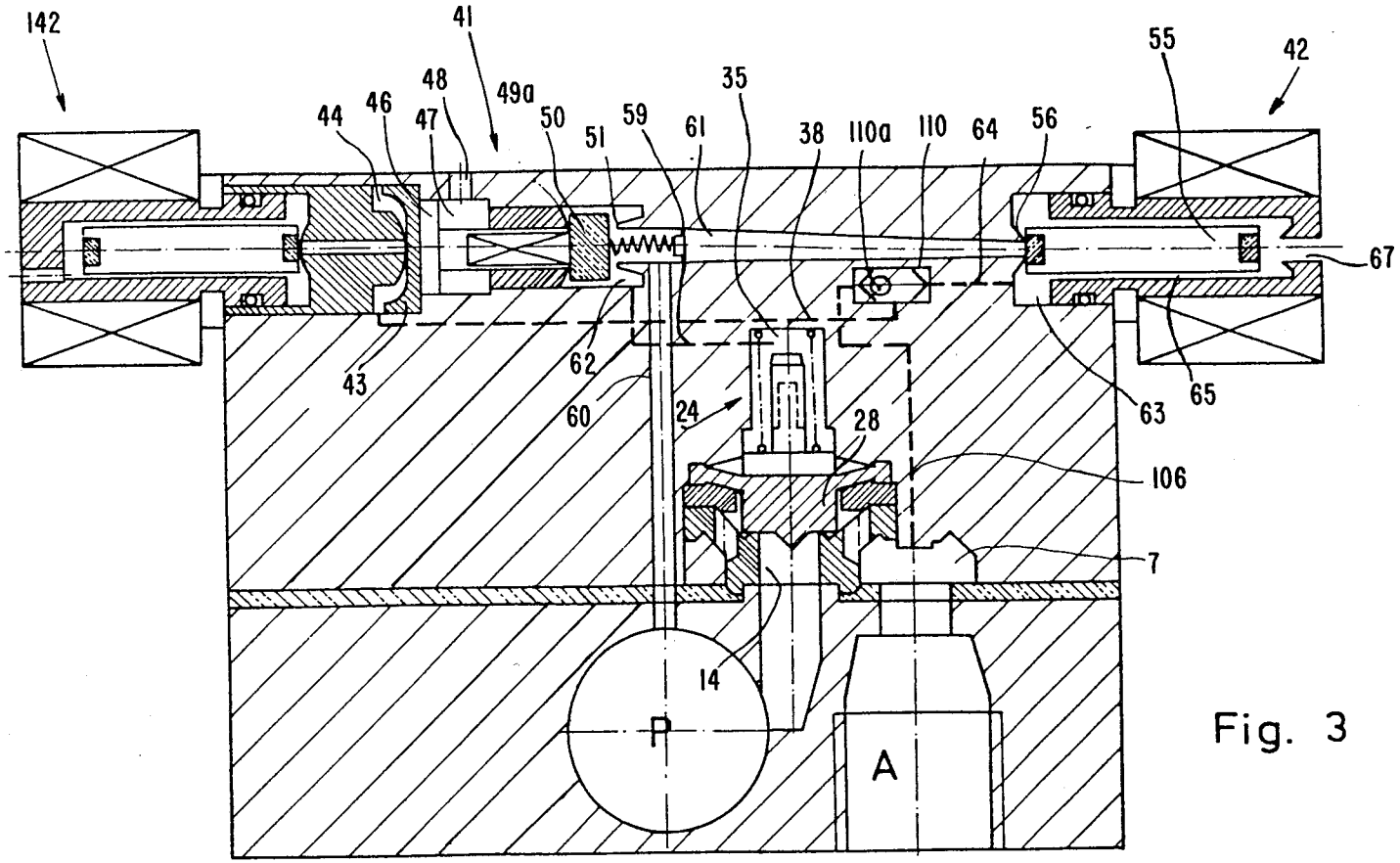

FIG. 3 shows the application of the invention to a 2/2-way valve (i.e. a valve with 2 connections and 2 switch positions). Here too the same parts are designated by the same reference numerals as in FIGS. 1 and 2. The representation in FIG. 3 has been kept quite schematic and is not definitive for the construction. Thus in particular the housing can be kept substantially smaller than in the embodiment according to FIG. 1; also the two servo valve elements 42 and 142 and the inverter valve element 140 can be arranged in a space-saving manner other than the illustrated arrangement.

The valve according to FIG. 3 contains only one single valve element 24 for the P/A function, i.e. for connecting the connections P and A.

In the illustrated first switch position of the inverter valve element 41 the pressure chamber 35 of the valve element 24 is acted upon by compressed air from the connection P via the channels 60, 61 and 69. Consequently the connection between the connections P and A is broken.

If an actuating impulse is now supplied to the servo valve element 42 so that the plunger 55 goes into the right-hand end position, the pressure medium passes out of the channel 61 via the pressure chamber 63 and the channel 64, the OR valve element 110 and the channel 38 into the pressure chamber 44. As a result of this the piston rod 46 moves towards the right and closes the nozzle 51 with the seal 50. This interrupts the supply of pressure medium to the pressure chamber 35 and at the same time air is removed from this pressure chamber 35 via the channel 69, the chamber 47 and the bore 48. Under the effect of the pressure of the pressure medium in the connecting chamber 14 the diaphragm 28 is lifted and as a result a connection is produced between the connections P and A.

If the actuating impulse supplied to the servo valve element 42 ceases, so that the plunger 55 returns to the left-hand position and thus breaks the connection between the channel 61 and the channel 64, the valve body 110 of the OR valve element 110 is switched over into its right-hand position by the pressure difference between the channels 64 and 106 so that the pressure chamber 44 is further acted on by pressure medium from the chamber 7. Thus the piston rod 46 keeps the seal 50 firmly on the valve seat 51.

If the valve is to be switched over again into the position illustrated in FIG. 3, an actuating impulse is supplied to the servo valve element 142. As a result air is removed from the pressure chamber 44 in the manner already described, so that the pressure in the channel 61 can lift the seal 50 from the valve seat 51, as a result of which pressure medium is again supplied to the pressure chamber 35 and the diaphragm 28 is pushed downwards onto its valve seat.

Figure 4:
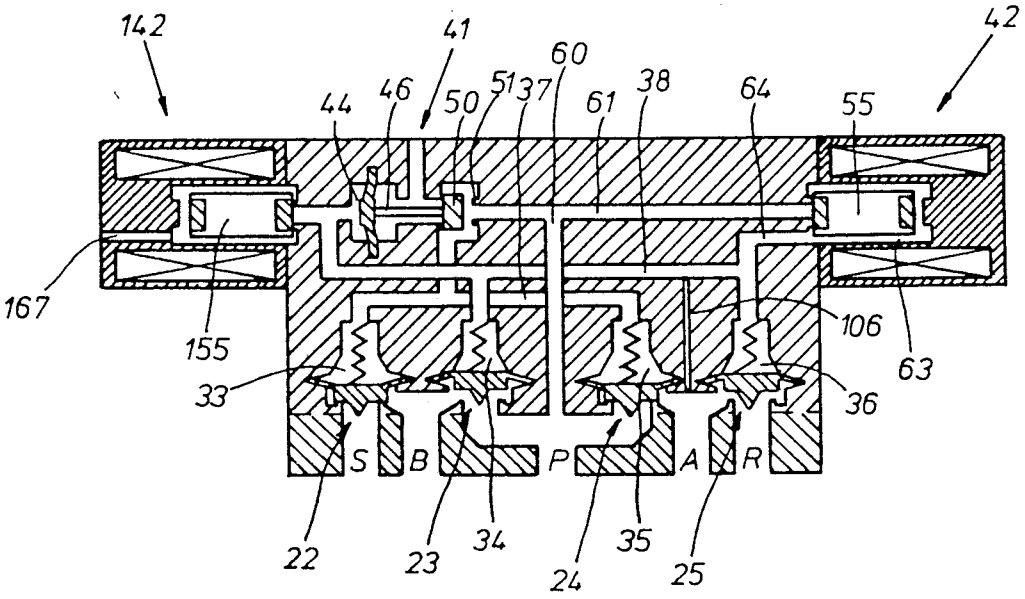

A further embodiment of the invention is illustrated in FIG. 4 (in a very schematic representation). Again the same reference numerals are used for the same parts as in FIGS. 1 to 3. The construction according to FIG. 4 represents a variant of the construction according to FIG. 1. By contrast with the arrangement according to FIG. 1 the valve according to FIG. 4 does not contain the OR valve element 110. In addition not only the servo valve element 142 but also the servo valve element 42 is constructed as a 2/2-way valve.

In the embodiment according to FIG. 4, between the pressure chamber 63 of the servo valve element 42 and the pressure chamber 44 of the inverter valve element 41 there is a clear passage 38, 64 to which the connecting channel 106 coming from the connection A and having a reduced diameter is directly connected.

The two connections of the servo valve element 42 are connected on the one hand to the connection P (via the channels 60, 61) and on the other hand to the connecting channel 64, 48 leading to the pressure chamber 44 of the inverter valve element 41.

The way in which the valve according to FIG. 4 functions is as follows:

In the first switch position illustrated in FIG. 4 the passage of pressure medium between the connections B and S and between the P and A is shut off. The consuming device connected to the connection B is supplied with compressed air; air is removed from the consuming device connected to the connection A. For switching over to the second switch position the servo valve element 42 receives an impulse. As a result the plunger 55 goes into its right-hand position, so that pressure medium passes from the channel 61 into the channels 64, 38 and into the pressure chamber 44. Thus the piston rod 46 pushes the seal 50 onto the valve seat 51. In this way air is removed from the pressure chambers 33, 35 and the pressure chambers 34, 36 are supplied with pressure medium. Thus a connection is produced between the connections P and A as well as between B and S, whilst the connection between P and B as well as between A and R is shut off.

After the valve element 24 has been switched over the connecting channel 38 is supplied with pressure medium via the channel 106, even if after the actuating impulse supplied to the servo valve element 42 has ceased the plunger 55 again goes into its left-hand position. The second switch position is maintained in this way until an actuating impulse is supplied to the servo valve element 142. This results in air being removed from the pressure chamber 44 via the bore 167 in the manner already described, so that the piston rod 46 moves towards the left. As a result the pressure chambers 33, 35 are again supplied with pressure medium, whilst air is removed from the pressure chambers 34, 36 via the bore 167. The choice of a smaller passage cross-section for the channel 106 (by comparison with the cross-section of the channel 38) ensures reliable switching over to the first switch position.

A particular advantage of the bistable construction illustrated in FIG. 4 resides in the fact that for a monostable construction (in which the servo valve element 142 is omitted) the same basic body of the valve can be used.

Whenever the embodiments which have been described only shown diaphragm valves the invention is of course also applicable to other seat valves.

What is claimed is:

1. In a valve having at least one connection P for a pressure medium source and a connection A for the supply of pressure medium to a consuming device, at least one control valve element actuated by a pressure medium to provide a P/A connect/disconnect function and having a movable valve body which cooperates with a valve seat and is connected to a pressure chamber, a first servo valve element, an inverter valve element actuated by said pressure medium via said servo valve element, and an actuating piston which in a first switch position allows the pressure medium to pass from the pressure medium connection P to said pressure chamber, thus breaking the connection between the connections P and A, and in a second switch position draws off the pressure medium from the pressure chamber of said valve element, thus producing a connection between the connections P and A in which a pressure chamber of said first servo valve element is connected to the pressure chamber of said inverter valve element via a connecting channel, the improvement comprising a connecting channel between said connection A and said connecting channel leading from the pressure chamber of said first servo valve element to the pressure chamber of said inverter valve element, a second servo valve element means for drawing off the pressure medium from the pressure chamber of said inverter valve element, and means for actuating said second servo element in response to an impulse for switching said inverter valve element over to said first switch position.

2. A valve according to claim 1 including a connecting channel between the pressure chamber of said first servo valve element and the pressure chamber of said inverter valve element, an OR valve element in said connecting channel connecting a first input of said OR valve to the pressure chamber of said first servo valve element, means connecting a second input of said OR valve to the connecting channel connected to said connection A, and means connecting the output of said OR valve to the pressure chamber of said inverter valve element, said first servo valve element being a $\frac{2}{3}$-way valve having three connections including a first connection to said connection P, a second connection to one input of said OR valve element, and a third connection to atmosphere, said second servo valve element being a 2/2-way valve and having two connections including a first connection to the pressure chamber of said inverter valve element and a second connection to atmosphere.

3. A valve according to claim 2 including a connection R for the removal of pressure medium from the consuming device, and a second control valve element actuated by said pressure medium to establish an A/R connect/disconnect function, each of said control valve elements having a movable valve body and a cooperating valve seat, and means connecting each respective control valve element to a pressure chamber, wherein said connecting channel leads from the output of said OR valve element to the pressure chamber of said inverter valve element and is connected to the pressure chamber of one of said two control valve elements for the A/R function.

4. A valve according to claim 2 having a connection B for the supply of pressure medium to a second consuming device, a connection R for the removal of pressure medium from the first consuming device, a connection S for the removal of pressure medium from the second consuming device, and four valve elements actuated by the pressure medium operable to establish B/S, P/B, A/P and A/R connect/disconnect functions, each of said valve elements having a movable valve body and a cooperating valve seat, and means connecting each valve element to a pressure chamber, whereby said inverter valve element in a first switch position allows the pressure medium to pass from the connection P into the pressure chambers of said valve elements for the B/S and P/A functions, thus breaking the connection between the connections B and S as well as P and A, and in a second switch position draws off the pressure medium from the pressure chambers of such valve elements, thus producing the connection between the connections B and S as well as P and A, and wherein said connecting channel leads from the output of the OR valve element to the pressure chamber of said inverter valve element and is connected to the pressure chamber of the valve elements for the P/B and A/R functions.

5. A valve according to claim 1 including a clear connecting channel to which the connecting channel coming from said connection A is directly connected and which is connected between the pressure chamber of the first servo valve element and the pressure chamber of said inverter valve element, said first servo valve element being a 2/2-way valve having its two connections connected respectively to the connection P and to the connecting channel leading to the pressure chamber of said inverter valve element, said second servo valve element being a 2/2-way valve having its two connections connected to the pressure chamber of said inverter valve element and to atmosphere.

6. A valve according to claim 1 wherein the cross-section of the connecting channel connected to the connection A is smaller than the cross-section of the connecting channel leading from the pressure chamber of said first servo valve element to said pressure chamber of said inverter valve element.

* * * * *

UNITED STATES PATENT AND TRADEMARK OFFICE

CERTIFICATE OF CORRECTION

PATENT NO. : 4,787,415

DATED : November 29, 1988

INVENTOR(S) : Telscher

It is certified that error appears in the above-identified patent and that said Letters Patent is hereby corrected as shown below:

Column 3, line 54, change "form" to -- from --.

Column 7, line 2, change "48" to -- 38 --.

Column 8, line 65, change "chamber" to -- chambers --.

Signed and Sealed this

Fourth Day of April, 1989

*Attest:*

*Attesting Officer*

DONALD J. QUIGG

*Commissioner of Patents and Trademarks*